US005967015A

United States Patent [19]

Grebe

[11] Patent Number: 5,967,015

[45] Date of Patent: Oct. 19, 1999

[54] PUNCHING TOOL

[75] Inventor: Wolfgang Grebe, Lechbruck, Germany

[73] Assignee: Karl Marbach GmbH & Co., Heilbroon, Germany

[21] Appl. No.: 08/921,403

[22] Filed: Aug. 29, 1997

Related U.S. Application Data

[63] Continuation of application No. 08/568,184, Dec. 6, 1995, abandoned.

[30] Foreign Application Priority Data

Dec. 7, 1994 [DE] Germany ..... 44 43 613

[51] Int. Cl.[6] ..... B26F 1/14

[52] U.S. Cl. ..... 83/686; 83/684; 83/697

[58] Field of Search ..... 83/686, 697, 684

[56] References Cited

U.S. PATENT DOCUMENTS

| | | | |
|---|---|---|---|
| 2,349,336 | 5/1944 | Batchelder | 83/663 |
| 4,526,077 | 7/1985 | DeGuvera | 83/686 |

*Primary Examiner*—M. Rachuba
*Assistant Examiner*—Sean Pryor
*Attorney, Agent, or Firm*—Marshall & Melhorn

[57] ABSTRACT

The punching blades acts to punch out parts of any desired shape from paper, cardboard, pasteboard, plastics material foils, leather, rubber and the like. In order that an optimum cutting quality can be generated from the start using the punching blade, the punching blade has a cutting edge which comprises a curvature with a radius of from 0.005 to 0.060 mm.

6 Claims, 2 Drawing Sheets

PUNCHING TOOL

CROSS REFERENCE TO RELATED APPLICATION

The present application is a continuation of U.S. patent application Ser. No. 08/568,184, now abandoned entitled PUNCHING TOOL filed on Dec. 6, 1995, in the name of Wolfgang Grebe. The benefit of the earlier filing date of said application is specifically claimed.

BACKGROUND OF THE INVENTION

1. Field of the Invention

The invention relates to a punching tool for punching out parts of any desired shape from paper, cardboard, pasteboard, plastics material foils, leather, rubber and the like.

2. Description of the Prior Art

Punching tools of the type that is known, for example, from DE-PS 33 17 777 Cl, are preferably used in strip steel punching tools for punching out parts of any desired shape from flat materials, in particular folding box blanks. They are increasingly also used in rotational punching tools for the same purposes.

The punching tools must fulfill three conditions: first, the material must be reliably and completely separated over the entire punching surface, so that no damage to the product occurs in the subsequent operating steps; second, the cut piece must come away perfectly with very little dust and fiber and with smooth cut edges; and, thirdly, the cutting friction should be as small as possible, this being shown in the number of good punching operations. Using blades of the type that exist at present, these three requirements can only be achieved in an inadequate manner.

The cutting edges of the known punching tools are usually produced by grinding, scraping, and, at present, by means of lapping, based on the principle that the cutting edge should be as sharp as possible. Cutting edges which are significantly below 0.010 mm are achieved, but these have an uneven microsaw-like contour and, owing to the production, the smallest grinding burrs become attached thereto. These cutting edges must first be equalized and smoothed, in alternating action with the cutting material, such that, subsequently, the best possible cutting quality can be obtained. Depending on the cutting quality, several thousand punching operations may be necessary for this.

These very narrow cutting edges are exceptionally sensitive to mechanical loads, in particular to pressure. A particular significance is attached thereto because the usual operating method with this punching technology of the above-mentioned type is that of steel on steel, i.e., the blade cutting edges operate against a reinforced printing plate.

The punching lines have, for reasons of production, height differences of +/−0.02 mm. In addition, further height tolerances are generated from the punching machines, the tool production and the handling of the punching processes.

In inexpedient cases, all the mistakes accumulate, such that height differences of up to 2 mm cannot be considered impossible.

In order to guarantee that the complete separation of the stamping material is ensured, the height differences must be compensated in such a manner that the very sensitive cutting edges are not damaged by overloading.

In practice, the punch is subjected to pressure until 50% of all cutting points are separated. Subsequently, the remaining differences in height are equalized by means of subsequent adhering with suitable strips of different strengths. Depending on the box blank, up to 100 m of punching lines may be found in one strip steel stamping mold, as a result of which the equalization of the height differences known in the technical field as "preparation" requires much care and experience and takes many hours during which the punching machine is inactive. These preparation times are, in some cases, longer than the subsequent actual production time. These times when the machine is inactive cause unproductive additional costs. Frequently this leads to the punches being brought together so far that the largest part of the punching line separates, but at the expense of a large part of the cutting edges being damaged or destroyed. Under the excess pressure, the cutting edge is deformed in an undefined manner. This causes a cut which is not clean, in the case of which dust and stamping hairs form to a greater extent and also leads to cardboard covers and rear parts tearing. The working life of cutting tools of this type is substantially reduced, such that the tools must be replaced prematurely, this causing correspondingly increased costs.

Many attempts have been made to make it possible to simplify the preparation or to replace it altogether. There is known, from DE 31 35 980 Cl, a strip steel punching tool of the initially-mentioned type, in which punching lines with deformable blade backs are used for automatic height equalization. This solution fails as regards the technical possibilities in the production of the intended deformation places on these punching lines.

DE 39 28 916 Cl, describes a process in which the cutting edges which are too high can deflect towards the rear against a soft metal plate. In this connection, the plate is work-hardened in the pressure area of the blade backs, such that a stabilized balance state sets in.

This process fails because of the constructive features of the punching machines which prevail in the market.

In the case of a strip steel punching tool which is known from DE 33 17 777 Cl, the backs of the blades are formed as reinforced cutting edges and are mounted on a softer metal plate, in which, under the action of the punching pressure, they can deflect corresponding to the height difference. The production of these lines is expensive and, in practice, demonstrates that the soft plates become unusable prematurely owing to the digging in of the hardened back cutting edges as a consequence of fatigue factors. They must therefore be exchanged relatively rapidly, as a result of which, as regards cost, the technical advantages are lost.

More recently, it has been possible, in order to increase the working life, to coat the cutting edges in a manner which reduces wearing and friction. Coatings of this type are, in general, of a ceramic type with extremely high levels of hardness, but are correspondingly brittle. In-house tests have proved that these wear-reducing layers are likewise destroyed by the damage to the cutting edge until they lose their effect.

A cutting edge blade for cutting a moving cardboard sheet is known from U.S. Pat. No. 2,349,336, the cutting edge of which cutting edge blade has a curvature with a radius of 0.05 to 0.1 mm and a cutting angle of 55° to 80°. As a result of this cutting shape, it is intended that the cardboard sheet which is under a tensile stress be separated, before the cutting edge has moved completely through the cardboard sheet. A punching stroke is, however, not performed using this cutting blade.

SUMMARY OF THE INVENTION

A cutting blade is disclosed, the cutting edge of which generates an optimum cutting quality from the start. This object is achieved using a punching blade which has a cutting edge with a curvature having a radius of from 0.005 to 0.060 mm.

Owing to the curvature of the cutting edge, the punching blade generates, from the start, an optimum cutting quality. Furthermore, the punching blade may, during the preparation and the punching, be subjected to high loads without deforming plastically in a damaging manner under the punching pressure when it engages on the steel punching plate. Furthermore, the preparation time is short. Lastly, a cutting coating which reduces the wear can be provided to increase the working life.

Preferably, the curved cutting edge is additionally reinforced or surface finished.

In a preferred embodiment, the cutting angle of the curved edge is 30° to 60°.

During the punching process, the cutting edge first engages on the punching plate. In this line contact, a mutual flattening occurs in the area of contact, it being possible to assess this flattening, and thus also the tensions which result in the cutting edge, using the Hertzian equations. During punching, the punching blade is subjected to an increasing sustained pressure load, and, in the case of a typical strip steel, for example Ck 55, may not be loaded beyond a limit of approximately 1160N/mm$^2$. Ideal cutting conditions, for example in the case of a folding box cardboard of 300 g/m$^2$, only loads the steel in the cutting edge with a cutting edge radius of 0.010 mm to 350 N/mm$^2$.

In the case of the cutting blade design which is commercially usual, this value is higher, since neither a defined radius nor a sufficiently exact, even cutting edge width of 0.010 mm is present. In the case of an increasing cutting radius, the cutting load of the steel is reduced and is, for example, a cutting radius of 0.03 mm, calculated as approximately 180 N/mm$^2$. The calculation further shows that a curvature of the cutting edge of 0.010 mm supports, during the punching, an overload of approximately 100 N/cm punching line length until the critical stress of 1160 N/mm$^2$ is reached and approximately 330 N/cm in the case of a cutting radius of 0.030 mm.

Thus, a commercially usual cutting edge corresponding to a height difference of 0.035 mm, is overloaded, when the cutting edge widens to at least 0.015 mm and, in the case of an overload of 0.200 mm the cutting edge becomes 0.050 to 0.060 mm wide and is flattened unevenly over the cutting length, i.e., not rounded. The cutting quality is thereby severely reduced.

A cutting edge which is rounded according to the invention and has a radius of 0.030 mm displays, under the same conditions, no cutting alteration and generates perfect cutting edges in the cutting material. Comprehensive tests show that the cut is, for example in the case of folding box cardboard with undamaged cutting tips of up to 0.040 mm edge radii, perfect and cannot be told apart from edge radii of 0.010 mm.

DESCRIPTION OF THE PREFERRED EMBODIMENT

An embodiment of the invention is explained in more detail with reference to the attached drawings which show the cross-section of the cutting area of a punching blade.

Figure 1:
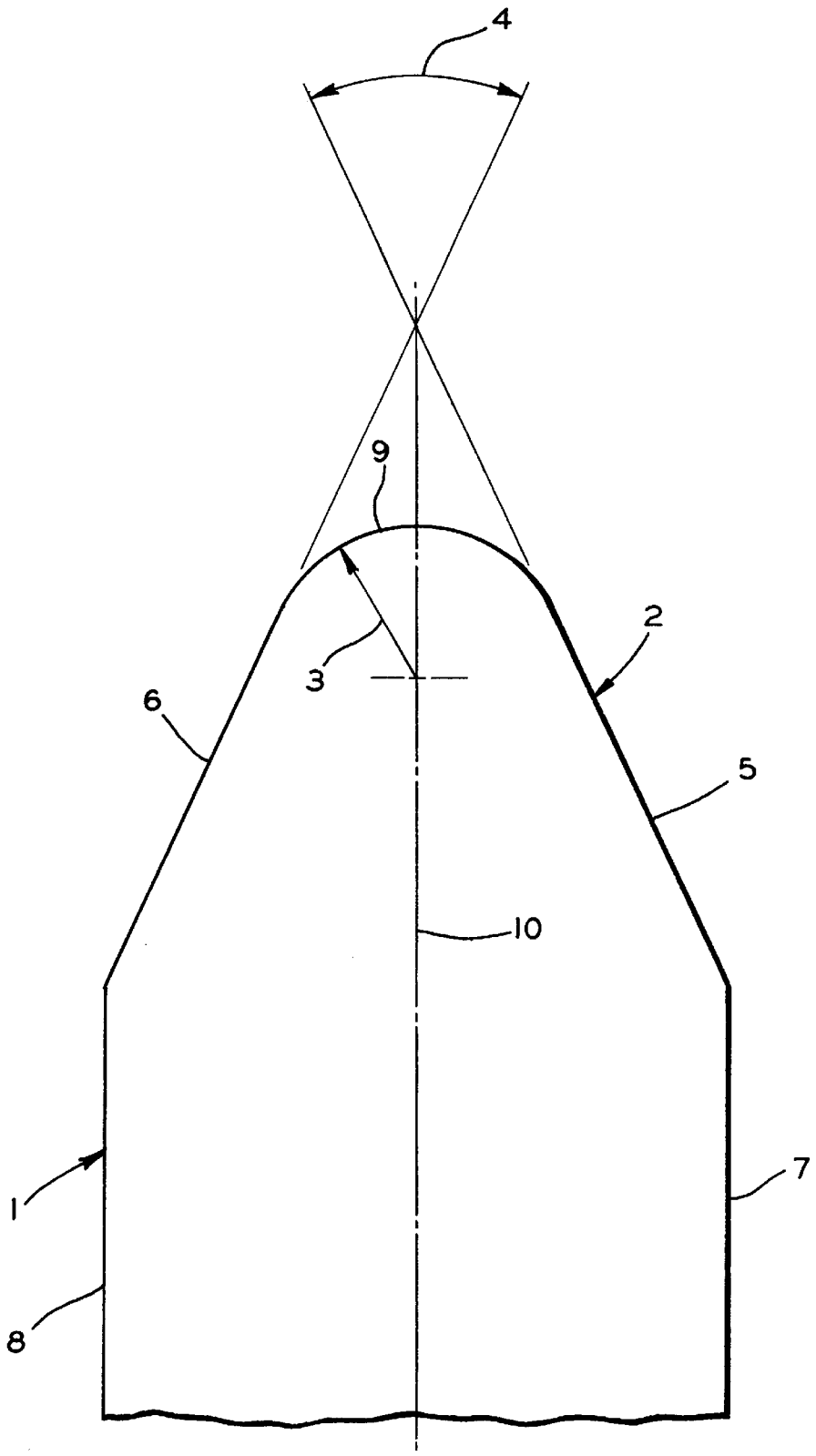
FIG. 1 is a fragmentary elevational view of a punching blade embodying the construction of the present invention.
Figure 2:
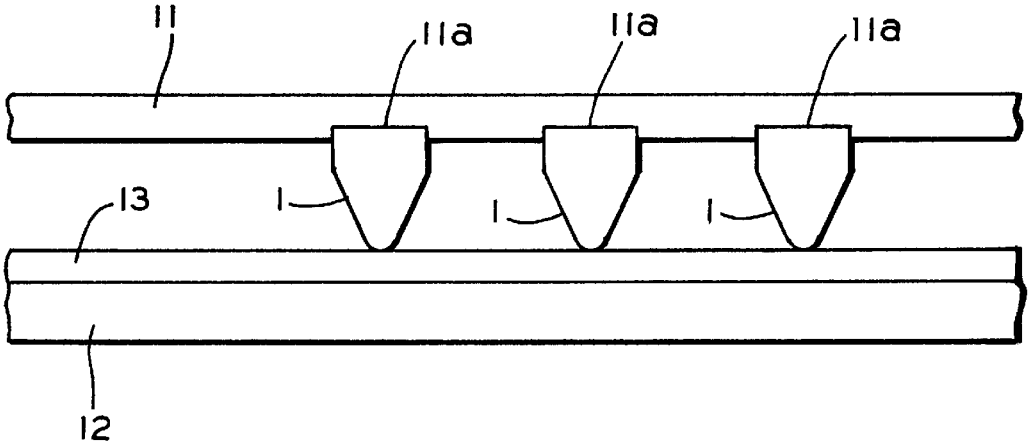
FIG. 2 is an elevational view showing a punching tool embodying the construction of the present invention.

The punching blade 1 shown in FIGS. 1 and 2 corresponds, substantially, to a punching blade as is shown in, for example, DE 39 28 916 Cl. A number of punching blades 1 of this type is, as a rule, mounted, together with grooves, 11A on the lower side of a supporting plate of a punching tool of a punching machine. The punching blades act, for example, to punch out folded boxes from cardboard 13 which is lying on a counter punching plate. During the punching process, the supporting plate 11 is acted upon by pressure and is moved toward the counter punching plate 12 until the punching blades 1 connect with the counter punching plate 12 and the cardboard is separated. Subsequently, the supporting plate is moved away from the counter punching plate.

The punching blade 1 according to the invention is formed longitudinally and comprises, on the end thereof which is turned towards the counter punching plate 12, a symmetrical cutting edge 2 which extends in the longitudinal direction thereof.

The cutting edge 2 comprises two slanting flanks 5, 6 which extend symmetrically to the longitudinal central plane 10 of the punching blade at a cutting angle 4 of preferably 30° to 60° to one another and merge into the side flanks 7, 8 of the punching blade 1. At the outer edges of the punching blade 1 the slanting flanks 5, 6 merge into a connecting curvature 9, which is likewise symmetrical to the longitudinal central plane 10 of the punching blade 1. The curvature 9 has a radius 3 of from 0.005 to 0.04 mm.

The curved cutting edge 2 can additionally be hardened or surface finished.

The curved punching blades with the enlarged surface contact reduce the impression as a result of the fact that the cutting edge does not dig so deeply into the punching sheet during the punching, such that the elevation at the impression is not so large. This is protective in the case of the punching material having a sensitive surface. The reduced impression resulting from the enlarged contact surface between the blade and the stamping sheet reduces the notch tensions in the vicinity of the impression and thus the untimely production of fatigue fractures in the punching sheet.

The punching blades lose height in connection with the wearing. A compromise between increased loadability of the blade and the wear can be introduced. A cutting radius of 0.020 mm is regarded as particularly expedient for this purpose. The curvature of the blade may be produced mechanically by remelting, for example by means of lasers and under the corresponding introduction of heat, normal and cutting-hardened punching blades, which arise as strip steel lines, from the fully processed tools or as bent ones in the case of rotational tools.

A plurality of punching blades 1 may be mounted on a supporting plate 11 for movement toward and away from a counter punching plate 12. A sheet 13 of flat material is shown in a stationary position between the punching blade 1 and the counter punching plate 12.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A steel punching blade for punching parts out of flat materials, said steel punching blade comprising:

a) a cutting edge which contacts a counter punching plate during a punching process, said cutting edge having a pair of converging slanting flanks connected by a connecting curvature of a radius of from 0.005 to 0.040 mm.

2. A punching tool, said punching tool comprising:

a) a counter punching plate;

b) a supporting plate which is moveable toward and away from said counter punching plate; and c) a plurality of steel punching blades for punching parts out of flat materials, said punching blades being mounted on said supporting plate, said punching blades having a cutting edge which contacts said counter punching plate when said supporting plate is moved in the direction of said counter punching plate, said cutting edge of each of said plurality of punching blades having a curvature with the radius of from 0.005 to 0.040 mm.

3. The steel punching blade defined in claim 2, in which said cutting edge is surface finished.

4. The punching tool defined in claim 2, in which said cutting edge includes a pair of converging slanting flanks forming an angle therebetween which is in the range from 30° to 60°.

5. The steel punching blade defined in claim 2, in which said cutting edge is additionally hardened.

6. A method for punching out parts from flat materials, said method including the steps of:

a) providing a reciprocating supporting plate on which a plurality of steel punching blades having a curved cutting edge with a radius of from 0.005 to 0.040 mm are mounted;

b) providing a stationary counter punching plate positioned to contact said steel punching blades when said supporting plate is moved toward said counter punching plate;

c) placing a sheet of flat material on said counter punching plate in a position between said counter punching plate and said supporting plate; and d) moving said supporting plate a sufficient distance such that said steel punching blades penetrate said piece of flat material and contact said counter punching plate, thereby punching out said parts.

* * * * *